US005944568A

United States Patent [19]

Rabal

[11] Patent Number: 5,944,568

[45] Date of Patent: Aug. 31, 1999

[54] BOAT MOTOR MOUNTING DEVICE WITH SLIDE GUIDE STRUCTURE

[75] Inventor: Clifford R. Rabal, Willis Point, Tex.

[73] Assignee: R & R Design, Inc., Terrell, Tex.

[21] Appl. No.: 09/217,387

[22] Filed: Dec. 21, 1998

[51] Int. Cl.[6] ..... B63H 21/26

[52] U.S. Cl. ..... 440/53; 440/58

[58] Field of Search ..... 440/53, 54, 61, 440/58; 248/640–643

[56] References Cited

U.S. PATENT DOCUMENTS

| | | | |
|---|---|---|---|
| 4,143,614 | 3/1979 | Jeanson et al. | 440/61 |
| 4,907,993 | 3/1990 | Thompson | 440/61 |
| 5,322,030 | 6/1994 | Brehmer | 440/61 |
| 5,782,662 | 7/1998 | Icenogle | 440/61 |

OTHER PUBLICATIONS

Lightweight, High Lift, "Hydraulic Lift Plates", Bob's Machine Shop, Inc., 1501 33rd Street SE, Ruskin, Fl 33570, Date Unknown.

CMC Market–Leader in Transom Jacks and After Market Tilt and Trims, 1997–1998, pp. 1–11, Cook Manufacturing Corp., P.O. Box 1737, 3920 South 13th, Duncan, OK 73534.

CMC The #1 Transom Jack, When we needed a Transom Jack, we wanted the best. We bought the CMC Power–Lift., 1997, Cook Manufacturing Corp., P.O. Box 1737, 3920 South 13th, Duncan, OK 73534.

*Primary Examiner*—Ed Swinehart

*Attorney, Agent, or Firm*—Gardere & Wynne L.L.P.; John W. Montgomery

[57] ABSTRACT

A boat motor mounting device is provided for mounting an outboard motor to a transom of a boat. A transom portion of the mount is adapted for fastening securely to the transom of the boat at a transom base from which a vertical side projects perpendicular to the transom base. A motor mounting portion is provided adapted for fastening securely to a motor at a motor base from which a vertical side projects perpendicular to the motor base. A vertical slide guide structure is formed for mating engagement between the transom side projection and the motor side projection. The vertical slide guide includes an elongated vertical protrusion and an elongated vertical groove, both of which are sized for overlapping, adjustable vertical sliding engagement. A releasable locking mechanism is provided to hold the elongated vertical protrusion and vertical groove in a desired fixed position so that the motor is held in the fixed position relative to the boat.

12 Claims, 4 Drawing Sheets

BOAT MOTOR MOUNTING DEVICE WITH SLIDE GUIDE STRUCTURE

TECHNICAL FIELD OF THE INVENTION

The present invention relates to a boat motor mounting device for mounting an outboard motor to the transom of a boat spaced back from the boat and so that the motor can be adjusted up or down relative to the boat.

BACKGROUND OF THE INVENTION

For many years, it has been known that mounting an outboard motor to the transom of a boat spaced back from the transom a distance of several inches to more than about one foot can be advantageous for boat performance. Particularly, it has been found that the propeller of the outboard motor is given a longer moment arm for purposes of turning, thereby increasing the maneuverability of the outboard motorboat, the propeller is also given more leverage with a longer moment arm, also for purposes of trimming (i.e., angularly directing the motor up or down to keep the hull flat on the surface of the water) and the propeller blade is spaced back from the hull in water that is less turbulent due to the movement of the hull through the water. Adjustably positioning the motor up or down relative to the boat also provides proper full submersion of the propeller in the water during operation.

In the past, mounting devices have been constructed using overlappingly engaged vertical channel plates. One plate was bolted to the transom and the other plate was bolted to the motor. The plates were moveably attached to each other. Thus, the motor was attached to the boat spaced back from the transom and was adjustable up or down to accommodate different sized boats, motors and propellers. Parallel sides of the boat and mounted plate were overlappingly connected to parallel sides of the motor-mounted plate. Spaced-apart vertical slots were formed in the sides and vertically spaced pairs of bolts were extended through the vertical slots in each of the overlapping parallel sides of the boat and the motor plates. Loosening the bolts allowed the plates to be slid vertically relative to each other to position the motor up or down with its propeller at a desired distance below the hull for operating in the water. After the position was adjusted, the pairs of side bolts could be tightened to frictionally lock together the overlapping parallel sides of the mounting plates at a desired vertical position. The contact of the bolts with the inside surfaces of the vertical slots also prevented horizontal and twisting improvement of one channel plate relative to the other. The motor were thus held in place against significant torque-bending forces, shear forces and vibration, particularly when modern outboard motors with up to 200 horsepower or more are mounted spaced back from the boat using the mounting device. Because of the high forces and adverse conditions, including the vibration of the motor and the corrosiveness of the wet environment in which the mounting devices must operate, reliability of prior mounting devices has not been good. There has been a significant failure rate.

It has been found by the inventor that the failure of existing mounting devices is due to a number of conditions, including the fact that vibration loosens and allows movement of the overlapping parallel sides of the mounting devices, in spite of the intended frictional locking contact under the tension of the bolts. The result is primary load-carrying by the bolts through the vertical slots. Thus, the forces are applied through the mechanical point contact or more precisely, short line contact, of the spaced-apart bolts on the inside surfaces of the vertical slots. Such point or short line contact at the interface between the bolts and the sides of the slots results in a significant stress riser effect or focal point of the load and vibration. This, coupled with the magnitude of the forces, the significant vibration and the corrosive environment, results in high incidence of cracking failures along the vertical slots. Because the point of contact stress rising effect is so dramatic, the size or strength of the structure might need to be increased by a factor of two or three or more to reduce failures of jack plates constructed according to the prior designs. A concurrent increase in weight and cost of materials also would be required to acceptably reduce the failures.

Thus, there has been a need for a boat motor mounting device that can mount a powerful outboard motor spaced back from a boat, that can allow vertical adjustment, that is lightweight, strong, economical and that reliably resists bending and cracking.

SUMMARY OF THE INVENTION

A boat motor mounting device is provided for mounting an outboard motor to a transom of a boat, spaced back from the transom. The motor mounting device comprises a transom mount adapted for fastening securely to the transom of the boat, having a transom base and at least one vertical transom projection substantially perpendicular to the transom base. A motor mounting device is adapted for fastening securely to the motor, having a motor base and at least one vertical motor projection perpendicular to the motor base. At least one vertical slide guide structure is formed for mating engagement between the vertical transom projection and the vertical motor projection. The vertical slide guide comprises an elongated vertical groove and a vertical protrusion—one formed in the vertical transom projection and one formed in the vertical motor projection. The elongated groove and elongated protrusion are correspondingly sized for overlapping vertical sliding engagement, allowing the transom mount and the motor mounting device to be moved vertically, relative to each other. A releasable locking mechanism is provided to hold the elongated protrusion and groove in a desired fixed position so that the boat motor is held in a desired fixed position relative to the boat to which it is thereby mounted.

According to a preferred embodiment, a boat motor mounting device is provided for mounting an outboard motor to a transom of a boat. The mounting device comprises a transom channel adapted for fastening securely to the transom of the boat, having a transom base and a first pair of spaced-apart, parallel side projections projecting perpendicular from the transom base and having at least one first part of a slide guide structure formed in each of the sides parallel to the vertical slots. A motor channel, adapted for mounting to a motor, is provided, having a motor base and a second pair of spaced-apart, parallel side projections, projecting perpendicular from the motor base. The spaced-apart, parallel side projections are spaced and sized for overlapping engagement with the first pair of side projections and have correspondingly positioned at least one second part of a vertical slide guide structure positioned and sized for sliding engagement along an overlapping length of each of the at least one first vertical slide guide structure. A locking mechanism is provided comprising threaded fasteners through vertical slots in said first and second pairs of parallel side projection for clamping the first and second vertical guide structures into engagement, thereby simultaneously providing shear strength along the entire length of overlap of the at least one vertical guide structure formed on the first and second parallel side projections and further providing a moment arm of support against bending corresponding to the length of the overlap.

BRIEF DESCRIPTION OF THE DRAWINGS

The foregoing objects, advantages, and features, as well as other objects and advantages, will become more apparent with reference to the description, claims and drawings below, in which like numerals represent like elements and in which:

DETAILED DESCRIPTION OF THE PREFERRED EMBODIMENTS

While the invention will be described with respect to preferred embodiment, it is not intended that the scope of the invention disclosed be limited only to the specific embodiments disclosed. The scope of the invention is intended to include other alternative embodiments within the scope of the invention described in Claims and to which the inventor is legally entitled.

Figure 1:
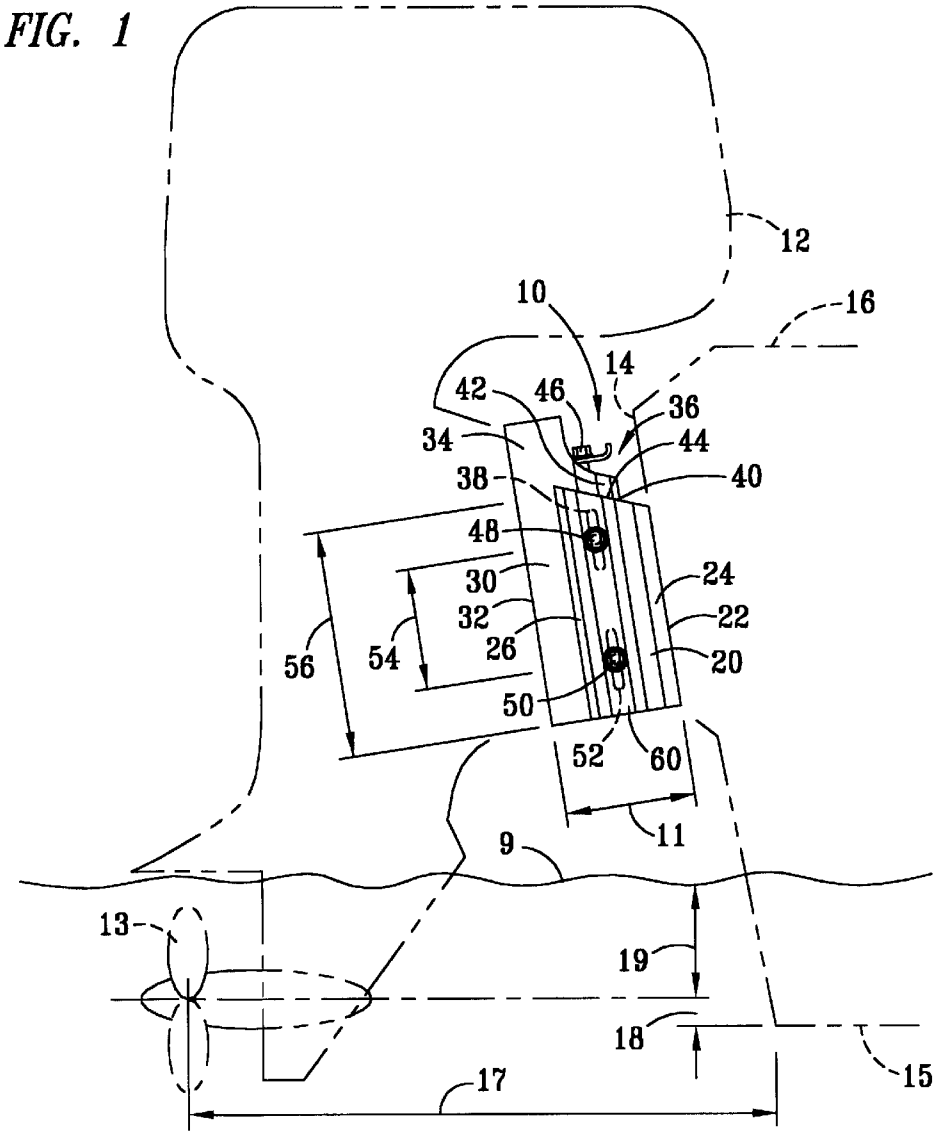
FIG. 1 is a schematic side plan view of the boat motor mounting device in position secured to a transom of a boat, partially shown in phantom lines, and secured to an outboard motor, also schematically shown in phantom lines.

FIG. 1 shows a schematic depiction of an boat motor mounting device 10, sometimes referred to as a jack plate 10, for mounting an outboard motor 12 (shown in phantom lines), to the transom 14 of a boat 16 (also shown in phantom lines. The boat motor mounting device 10, as depicted in FIG. 1, has a transom mount 20, having a transom base 24 adapted for fastening the transom mount 20 securely at 22 to the transom 14 of the boat 16. The transom mount 20 further includes at least one transom mount projection 26 rigidly affixed to the transom base 22, substantially perpendicular thereto and vertically oriented relative to the boat 16. The boat motor mounting device 10 further includes a motor mounting device 30 having a motor base 32 adapting for fastening securely to the outboard motor. The motor mount 30 includes at least one vertical mount projection 34 substantially perpendicular to the motor base 32 and vertically aligned for overlapping engagement with the transom projection 26. As more clearly understood with reference also to the perspective view of mounting device 10 shown in FIG. 2, at least one vertical slide guide structure 40 is formed for mating engagement between the transom projection 26 and the motor projection 34. The vertical slide guide 40 comprises at least one elongated vertical protrusion 42 and an elongated vertical groove 44, one of which is formed in the transom projection 26 and the other which is formed in the motor projection 34. The elongated vertical protrusion 42 and groove 44 are correspondingly sized for overlapping adjustable vertical sliding engagement, thereby providing a slide guide structure 40. A releasable locking mechanism 36 is provided to hold the elongated protrusion 42 and groove 44 in a desired fixed position so that the motor 12 is held in the fixed position relative to the boat 16. Although it is not depicted, the motor 12 may typically include its own tilt or trim adjustment, either mechanically or hydraulically operated, which would normally mount directly to the transom 14 of a boat 16, absent the boat motor mounting device 10, or jack plate 10, according to the present invention. The jack plate 10 is provided with at least one vertical slot 38 by which the transom mount 20 and the motor mounting device 30 may be adjustably moved vertically up and down, relative to each other. This allows the user to selectably and adjustably position the propeller 13 of boat motor 12 relative to the bottom 15 of boat 16. Thus, the outboard motor 12 is spaced back from the boat 16 an additional amount corresponding to the width 11 of the jack plate 10 to provide an increased moment arm 17 from the application of force by the propeller 13 to the hull of the boat 16. Also motor 12 is adjustably positionable at a desired position 18 relative to the bottom 15 of the boat 16 so that propeller 13 is positioned a desired distance 19 below the surface of water 9.

In the embodiment depicted in FIG. 1, a vertical adjustment and locking mechanism 36 comprises locking at least one bolt 48 inserted through at least one vertical slot 38, loosenable to allow the motor mount 30 to move vertically relative to the transom mount 20, and an adjustment screw 46 is threadably engaged between transom mount 20 and motor mounting device 30 to cause the motor mount 30 to move relative to the transom mount 20 using adjustment mechanism 46. In the embodiment depicted, vertical adjustable mechanism 46 may comprise an adjustment screw. When the motor 12 is in the desired position relative to the boat 16, the at least one bolt 48 may be tightened to frictionally engage the sides of the transom side projection 26 with the motor side projection 34. Preferably, another locking bolt 50 is provided in another vertical slot 52 spaced-apart a vertical distance 84 to provide even application of frictional locking force.

Figure 2:
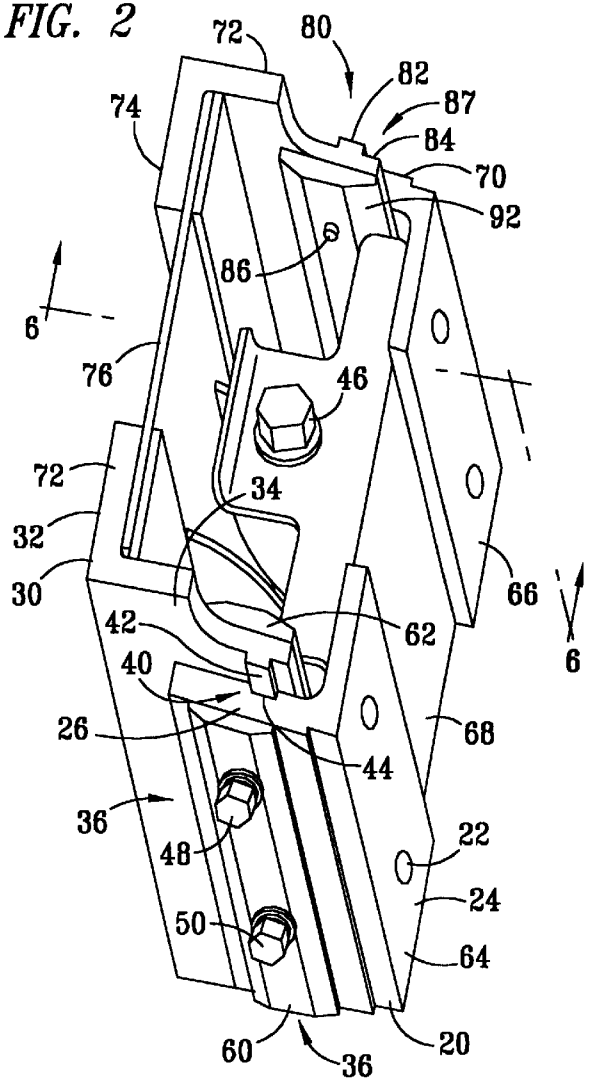
FIG. 2 is a perspective view of one embodiment of the inventive boat motor mounting device of FIG. 1.

Advantageously, at least one transom projection 34 and at least one motor projection 26 have at least one vertical slide guide structure 40 formed therebetween, preferably comprising at least one elongated vertical groove 42 and a corresponding elongated protrusion 44. For example, the vertical groove 42 may be formed in the transom mount side projection 26 and the elongated protrusion 44 formed in the motor mounting device projection as depicted in FIGS. 1 and 2. Alternatively, the elongated groove 42 may be formed in the motor mounting device side projection 34 and the elongated protrusion 44 may be formed in the transom mount side projection 26 (this alternative embodiment is not shown but will be considered an equivalent to the embodiment depicted by those skilled in the art). In a preferred embodiment, the fastening mechanism 36 further includes a first large area plate 60, such as a gibb plate 60, and also preferably a second large area plate 62 or large area nut 62, such as the threaded gibb plate 62 depicted in the figures, held together with a fastener 38 to "sandwich" the transom projection and the motor projection therebetween. The large area of the first and second gibb plates 60 and 62 advantageously helps to spread the holding force over the entire elongated overlapping length and area of the vertical slide guide structure 40.

Although those skilled in the art might, upon reading Applicant's disclosure, understand that the elongated vertical groove 42 and the elongated protrusion 44 may be formed with consistent cross-sectional size and shape therealong wherein said cross-sectional shape of said vertical groove and said cross-sectional shape of said elongated protrusion are substantially the same shapes, such as heart-shaped, triangular-shaped, rectangular-shaped, trapezoid-shaped, rounded-shaped or other geometric shape. It has been found that a substantially rectangular shape or a square shape may be advantageous over certain other shapes because pushing and pulling forces of the motor on the mount are resisted by contact between flat vertical surfaces of the elongated groove and the elongated protrusion. While other shapes may be useful, such as an arc, a semi-circular shape, or a triangular shape, the bolt or other mechanism holding the groove and protrusion into engagement would be required to resist wedging of one angled or curved surface relative to the other. Also, although a tongue-and-groove shape, such as a trapezoidal shape, could be formed, it has been found that very close manufacturing tolerances are required and the costs to manufacture such shape are increased over the rectangular or square-shaped cross-section of the elongated vertical groove and elongated vertical protrusions.

Also advantageously, the overlapping length 56 of the elongated vertical groove 42 and the elongated protrusion 44 will be longer, or at least as long, as the spaced-apart distance 54 of locking bolts 48 and 50 and any adjusted position of the boat mount 30 relative to the transom mount 20. Thus, the moment arm of the support provided by the slide guide structure will be greater than the moment arm of support that might be provided only by point contact of bolts 48 and 50 in slots 38 and 52. Further advantageously, the bending, twisting and vibrational forces imparted by the motor 12 will be distributed along the entire overlapping length 76, rather than at focal points at positions of bolts 48 and 50. The gibb plate 60 acts to maintain the overlapping engagement of protrusion 42 and groove 44, even in the event that bolts 48 and 50 loosens slightly so that locking friction is lost between side projections 26 and 34. Motor 12 will still be supported against bending and twisting due to the overlapping engagement between the elongated vertical groove and the elongated vertical protrusion. The vertical position of the motor relative to the boat will also be maintained through the vertical adjustment mechanism 46. Thus, the motor will continue to operate properly without changing trim or other adjustments that might be important, or even critical, to boat control, as in the case of a high-powered racing boat, thereby avoiding potential failure that might otherwise result in prior art mounting devices.

FIG. 2 shows a perspective view of a boat motor mounting device or jack plate 10 according to one embodiment of the present invention in which the transom mount 20 comprises a transom channel formed by the transom base 24 and a first side projection 26 and a second side projection 28 parallel to the first side projection 26. The base 24 may be a continuous unitary plate or may be formed of first transom base plate 64 and second transom base plate 66 interconnected with a third connection plate 68, as depicted for convenience of construction and for materials savings. Similarly, the motor mounting device 30 comprises a motor channel formed by a first vertical side projection 34 and a second vertical side projection 70 parallel to the first vertical slide projection 34. The base 32 may be formed of a continuous, unitary plate (not shown) or f first and second motor base 72 and 74, interconnected with a connection plate 76. A second motor mount side projection 78 is provided parallel to motor mount side projection 34 spaced apart therefrom for engagement with second transom projection 70 along a second slide guide 80 formed therebetween. In this embodiment, slide guard structure 80 includes another elongated vertical protrusion and corresponding elongated vertical channel 84, including bolts 86 (and 88, not shown) and gibb plates 90 (not shown) and 92. This construction adds additional strength in the engagement between first and second parallel projections from both the transom base and the motor base, both engaged with an overlapping slide guide structure including elongated protrusions and elongated channels lockably engaged with locking mechanism 36 and a second locking mechanism 84, providing support against twisting, bending and vibration distributed along the overlapping engagement between protrusions 42 and 44 and protrusions 80 and 82.

Figure 3:
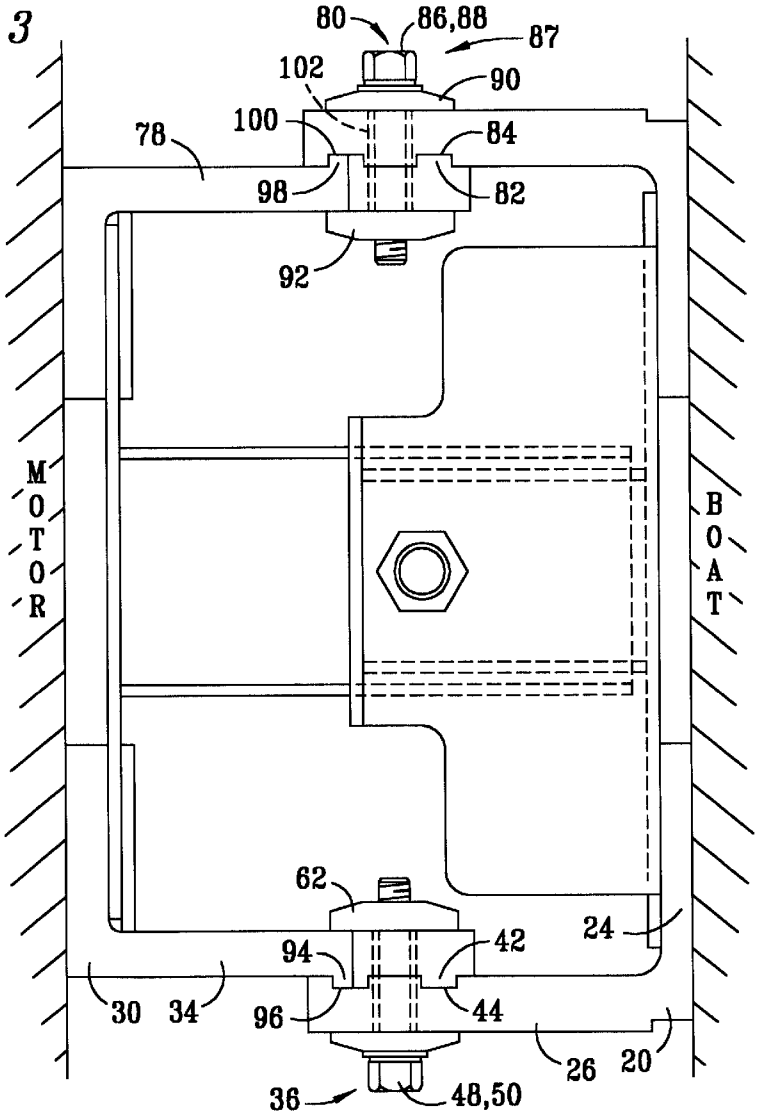
FIG. 3 is a top plan view of an alternative preferred embodiment depicting a boat motor mounting device for spacing a boat motor back a significant distance from the transom and further depicting pairs of slide guide structures and, more particularly, elongated grooves and protrusions, according to the present invention.

FIG. 3 depicts a top plan view of a preferred alternative embodiment of a boat motor mounting device 10 according to the present invention in which the spaced-apart distance between transom base 24 and motor base 32 is schematically depicted as greater than that in FIG. 2. In the embodiment in FIG. 3, the first and second slide guide structures 40 and 80 advantageously each include an additional channel and protrusion. Thus, slide guide structure 40 comprises elongated protrusion 42 and corresponding channel 44 and also a second parallel elongated protrusion 94 and second elongated channel 96, thereby forming a pair of parallel protrusions 44 and 94 with corresponding parallel channels 44 and 96 aligned with and straddling slots 38 and 52. Similarly, the other slide guide structure 80 comprises a first elongated protrusion 82 and a first elongated channel 84 and also a second elongated protrusion 98 and a second elongated channel 100 aligned with and straddling another vertical adjustment slot 102 (shown in hidden lines in FIG. 3.

Figure 4:
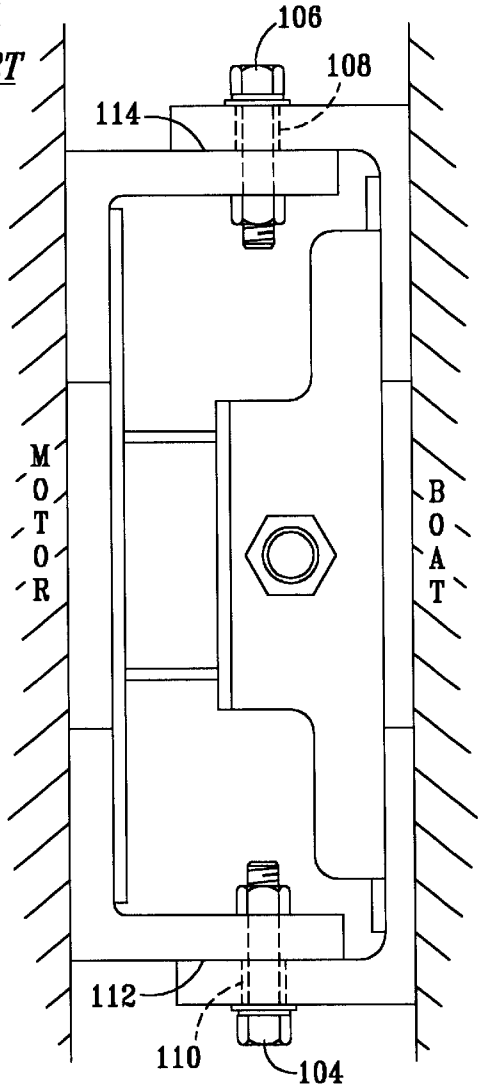
FIG. 4 PRIOR ART
FIG. 4 is a schematic depiction of a prior art mounting device.

For purposes of comparison only, FIG. 4 schematically depicts a prior art boat mounting device by which the overlapping side projections are adjustably secured with bolts 104 and 106 in vertical slots 108 and 110. Without a slide guide structure according to the present invention at the interface surfaces 112 and 114, resistance to bending, twisting and vibration is often relegated to the contact of bolts 104 and 106 against the inside surfaces of the slots 108 and 110. Thus, the forces carried by the prior art mounting device easily become localized at the points or lines of contact of the bolts with the slots whenever vibration, force and wear allows any slippage at surfaces 112 and 114.

Figure 5:
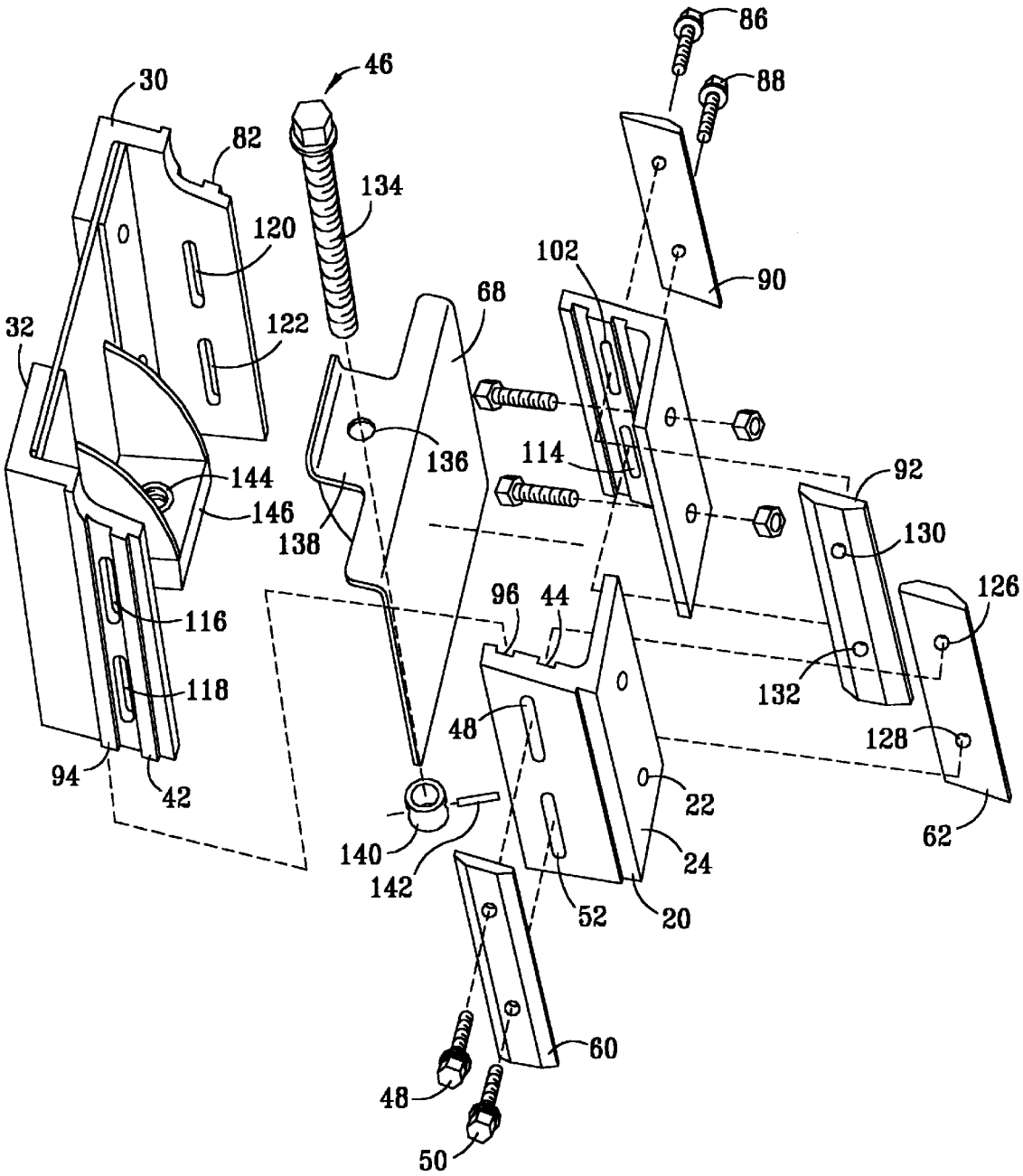
FIG. 5 is a schematic exploded construction view of the boat motor mounting device of FIG. 3 according to the present invention.

FIG. 5 shows an exploded construction view of the proffered embodiment of the boat motor mounting device of FIG. 3 and may be referred to in connection with the foregoing description for greater understanding of the construction of the boat motor mounting device according to the present invention. First and second vertical adjustment slots 38 and 52, along with another first vertical adjustment slot 102 and another vertical adjustment slot 116 provide a first amount of vertical adjustment according to the length of the slots. All of the adjustment slots are desirably the same length and are spaced apart to allow full travel of bolts 48 and 70 (and also bolts 86 and 88). One aspect of the invention depicted in FIG. 5 and not present in prior art mounting devices include the capability of having additional vertical slots 118 and 120 in the first motor mount side projection 34 and corresponding additional first and second slots 122 and 124 formed in the second motor mount side projection 78. This allows an additional amount of bolt travel corresponding to the combined length of adjustment slots. Thus, increased adjustment is made available because of the support provided by the elongated slide guide structures 36 and 80 allows slots in both the transom projections and also the motor mount projections.

It will also be more fully understood with reference to FIG. 5 that for conservation of materials inside locking plates 62 and 92 may be threaded at 126,128, 130 and 132 so that they act both as clamping plates and also as the nuts for bolts 48, 50, 86 and 88.

Figure 6:
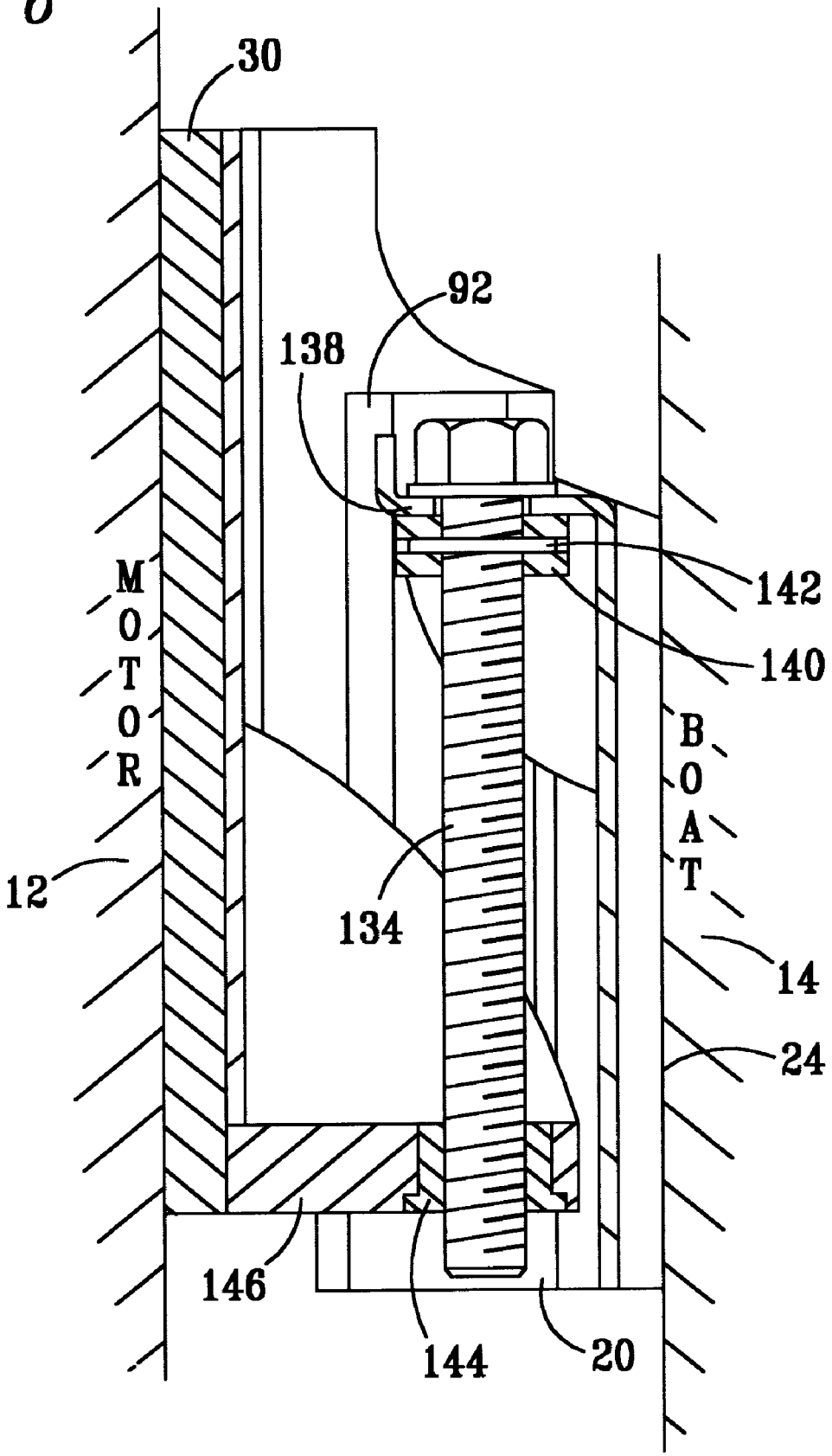
FIG. 6 is a partial cross-section view taken along section line 6—6 of FIG. 2.

Additional details of this construction may be more fully understood with reference to FIG. 6 which is a partial side cross-sectional view of the vertical adjustment mechanism 46, according to one embodiment of the present invention. It will also be more fully understood that the adjustment mechanism 46, according to this embodiment of the present invention, further comprises an elongated adjustment screw 134, turnably held in an orifice 136 formed in a top edge plate 138 rigidly attached to transom base connection plate 68 with a color bushing 140 securely fastened as with pin 142 to adjustment screw 134. Adjustment screw 134 further engages a threaded bushing 144 formed in a bottom edge plate 146. Bushing 144 may be conveniently constructed of a busing material welded in an orifice formed in bottom edge plate 146.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A boat motor mounting device for mounting an outboard motor to a transom of a boat, comprising:

a. a transom mount adapted for fastening securely to the transom of the boat having a transom base and at least one vertical transom projection perpendicular to said transom base;

b. a motor mount adapted for fastening securely to the motor having a motor base and at least one vertical motor projection perpendicular to said motor base;

c. at least one vertical slide guide structure formed for mating engagement between said transom projection and said motor projection, said vertical slide guide comprising an elongated vertical protrusion and an elongated vertical groove, said elongated groove correspondingly sized for overlapping adjustable vertical sliding engagement; and d. a releasable locking mechanism to hold said elongated protrusion and groove in a desired fixed position so that said motor is held in said faxed position relative to said boat.

2. A boat motor mounting device as in claim 1 wherein said at least one slide guide structure further comprises a first and a second vertical protrusion and a first and a second vertical groove, said first and second vertical protrusions and vertical grooves formed parallel to each other in a substantially vertical orientation relative to said boat when said motor is mounted thereon.

3. A boat motor mounting device as in claim 2 wherein said at least one first and said at least vertical protrusion comprise a protrusion having a substantially rectangular-shaped cross-section and said elongated vertical grooves comprise elongated grooves having substantially rectangular-shaped cross-section so that when held together in overlapping engagement, flat sides of said rectangular protrusions abut against flat sides of said rectangular grooves, to facilitate holding against forces applied by a motor mounted to a boat thereby.

4. A boat motor mounting device as in claim 1 wherein said at least one protrusion comprises an elongated ridge having a substantially rectangular cross-section and said at least one groove comprises at least one rectangular groove having a substantially rectangular cross-section.

5. A boat motor mounting device as in claim 1 wherein said locking mechanism further comprises:

a. at least one vertical slot through at least one of said vertical projections;

b. at least one large area plate;

c. at least one large area nut; and d. at least one threaded fastener through said plate, said slot, another of said projections and said nut to thereby hold said elongated vertical protrusion and elongated vertical groove in overlapping engagement.

6. A boat motor mounting device as in claim 1 further comprising an adjustment mechanism for adjustably sliding said elongated vertical protrusion and said elongated vertical groove relative to each other so that said motor mount and said transom mount are adjustably positionable relative to each other and so that said motor is adjustably positionable relative to said boat.

7. A boat motor mounting device as in claim 1 wherein:

a. said at least one vertical transom projection comprises a first vertical transom side projection and a second vertical transom side projection affixed parallel to each other and perpendicular to said transom base;

b. said at least one vertical motor projection comprises a first vertical motor side projection and a second vertical motor side projection affixed to said motor mount parallel to said first vertical motor side projection and perpendicular to said motor mount; and c. said at least one vertical slide guide structure comprises a vertical slide guide structure formed between said first vertical transom side projection and said first vertical motor side projection and a second vertical slide guide structure formed between said second vertical transom side projection and said second vertical motor side projection for overlapping adjustable vertical sliding engagement.

8. A boat motor mounting device as in claim 7 wherein said first vertical slide guide structure formed between said first transom projection and said first motor projection comprises parallel vertical elongated protrusions and parallel vertical elongated grooves correspondingly sized and positioned for overlapping adjustable vertical sliding engagement; and said second vertical slide guide structure formed between said second transom projection and said second motor projection comprises a pair of elongated parallel vertical protrusions and a pair of elongated vertical grooves correspondingly sized for overlapping adjustable vertical sliding engagement.

9. A boat motor mounting device as in claim 8 wherein said releasable locking mechanism further comprises at least two vertical slots through at least one of said first vertical transom projections or said first vertical motor projection and at least two vertical slots through at least one of said second vertical transom projection or said second vertical motor projection, said at least first two vertical slots aligned with each other and positioned parallel to and between said pair of the first elongated vertical protrusions and vertical grooves and said second to vertical slot vertically aligned and positioned between and parallel to said second pair of elongated vertical protrusions and elongated vertical grooves; and said releasable locking mechanism comprising pairs of the threaded fasteners extending through said two slots and said other projection.

10. A boat motor mounting device as in claim 9 wherein said releasable locking mechanism further comprises a first gibb plate to which said pair of threaded fasteners extends and a second nut plate into which said threaded fasteners are secured, said gibb plate and said nut plate positioned outside and inside of said overlapping vertical transom projection and vertical base projections thereby holding said elongated vertical protrusions and said elongated vertical grooves in overlapping engagement upon tightening said threaded fasteners.

11. A boat motor mounting device as in claim 1 further comprising:

a. at least one vertical slot through said vertical transom projection; and b. at least one slot through said at least vertical motor projection, said transom projection slot and said motor projection slot correspondingly positioned relative to said elongated vertical protrusion and said elongated vertical groove in a parallel relationship thereto, so that said transom projection slot and said motor projection slot are aligned for receiving a threaded fastener therethrough.

12. A boat motor mounting device for mounting an outboard motor to the transom of a boat, comprising:

a. a transom mount adapted for fastening securely to the transom of the boat having a base and first pair of spaced-apart parallel sides projecting perpendicular from said base and having a pair of aligned vertical slots in each of said sides and at least one first slide guide structure formed in each of said sides parallel to said vertical slots;

b. a motor mount having a motor base plate and a second pair of spaced-apart parallel sides projecting perpendicular from said motor base plate, said second pair of parallel sides sized for overlapping engagement with said first pair of sides and having a correspondingly positioned second pair of vertical slots in each of said second sides and at least one second vertical slide guide structure positioned and sized for sliding engagement along an overlapping length of said at least one first vertical slide guide structure; and c. pairs of threaded fasteners in each of said pairs of aligned first and second slots for clamping said first and second vertical guide structures into engagement, thereby simultaneously providing shear strength along the entire overlapping length of said at least one first and said at least one second vertical slide guide structures formed between the first and second parallel sides and further providing a moment arm of support against bending corresponding to said overlapping length.

* * * * *